US006007637A

United States Patent [19]

Sindzingre et al.

[11] Patent Number: 6,007,637

[45] Date of Patent: Dec. 28, 1999

[54] PROCESS AND APPARATUS FOR THE DRY TREATMENT OF METAL SURFACES

[75] Inventors: Thierry Sindzingre, Cachan; Stephane Rabia, Gif sur Yvette; Daniel Guerin, Chelles; Christian Larquet, Guyancourt, all of France

[73] Assignee: L'Air Liquide, Societe Anonyme pour l'Etude et l'Exploitation des Procedes Georges Claude, Paris, France

[21] Appl. No.: 08/746,876

[22] Filed: Nov. 18, 1996

Related U.S. Application Data

[63] Continuation of application No. 08/356,900, Dec. 15, 1994, abandoned, which is a continuation-in-part of application No. 08/075,311, Jun. 11, 1993, Pat. No. 5,458,856.

[30] Foreign Application Priority Data

Dec. 15, 1993 [FR] France ..... 93 15108

[51] Int. Cl.[6] ..... B08B 7/04

[52] U.S. Cl. ..... 134/2; 134/1; 134/15; 134/21; 134/36; 134/37

[58] Field of Search ..... 134/1.1, 1.2, 1.3, 134/1, 2, 21, 15, 37, 26, 34, 36, 32; 156/354, 379.6; 424/186, 186.05, 186.06; 118/723 R, 723 MW, 723 ME

[56] References Cited

U.S. PATENT DOCUMENTS

| | | | |
|---|---|---|---|
| 4,425,210 | 1/1984 | Fazlin | 204/19 ZE |
| 4,615,756 | 10/1986 | Tsujii et al. | 156/345 |
| 4,689,112 | 8/1987 | Bersin | 156/643 |
| 4,840,702 | 6/1989 | Schumacher, III | 156/643 |
| 4,929,319 | 5/1990 | Dinter et al. | 204/164 |
| 4,951,602 | 8/1990 | Kanai | 118/719 |
| 5,105,761 | 4/1992 | Charlet et al. | 118/723 ME |
| 5,211,825 | 5/1993 | Saito et al. | 204/192.32 |
| 5,225,659 | 7/1993 | Kusano et al. . | |
| 5,236,512 | 8/1993 | Rogers et al. . | |
| 5,458,856 | 10/1995 | Marie et al. | 422/186 |

FOREIGN PATENT DOCUMENTS

| | | |
|---|---|---|
| 0 305 241 | 3/1989 | European Pat. Off. . |
| 508833 | 10/1992 | European Pat. Off. . |
| 510503 | 10/1992 | European Pat. Off. . |
| 513634 | 11/1992 | European Pat. Off. . |
| 0 661 110 | 7/1995 | European Pat. Off. . |

OTHER PUBLICATIONS

Patent Abstracts of Japan, vol. 15, No. 361 (C–0867) Sep. 12, 1991.

American Heritage Dictionary of the English Languge, Third Edition, Hougghton Miffin Company, 1992.

McGraw–Hill Concise Encyclopedia of Science & Technology, Second Edition, McGraw–Hill Publishing Company, 1989.

*Primary Examiner*—Jill Warden
*Assistant Examiner*—Alexander Markoff
*Attorney, Agent, or Firm*—Burns, Doane, Swecker & Mathis, L.L.P.

[57] ABSTRACT

The invention relates to a process for the dry surface treatment of at least one metal surface portion, according to which the portion is treated at a pressure close to atmospheric pressure by a gaseous treatment atmosphere comprising excited or unstable species and substantially devoid of electrically charged species, obtained from a primary gaseous mixture and if necessary an adjacent gaseous mixture, the primary gaseous mixture being obtained at the gas outlet of at least one device for the production of excited or unstable gaseous species, in which an initial gaseous mixture comprising an inert gas and/or a reducing gas and/or an oxidizing gas has been converted, the adjacent mixture not having passed through the device.

12 Claims, 1 Drawing Sheet

PROCESS AND APPARATUS FOR THE DRY TREATMENT OF METAL SURFACES

This application is a continuation of application Ser. No. 08/356,900, filed Dec. 15, 1994, now abandoned, which is a continuation-in-part of application Ser. No. 08/075,311, filed Jun. 11, 1993, now U.S. Pat. No. 5,458,856.

BACKGROUND OF THE INVENTION (i) Field of the Invention

This invention relates to the stages for the preparation or treatment of metal surfaces taking place in the course of processes for the production or processing of flat products (such as sheet metal) or hollow bodies (bottles, valves, etc.).

Depending on the part of the production line for these products at which these stages take place, these preparation stages provide for cleaning, degreasing or activation of the surface, often prior to a subsequent process, which may be, e.g. annealing, the electroplating of zinc, aluminium, tin or alloys thereof, or the deposition of organic coatings, such as varnishes or paints, or inorganic coatings, such as nitrides or films based on silicon.

A stage of this kind for the preparation of surfaces may also take place at the end of the production line, e.g. just before sheet metal of this kind is coiled.

The products are made of steel, stainless steel, copper or, e.g. aluminium, depending on the final destination of the products in question (e.g. motor vehicles, electric household appliances, buildings or packaging, such as tins).

(ii) Description of Related Art

The methods most commonly used to effect these operations for the preparation of surfaces include first and foremost liquid-phase methods.

Examples in this category include the case of a preliminary degreasing stage effected with the aid of solvents, usually containing chlorine or fluorine (at present subject to very strict regulations) or methods consisting in degreasing the metal surface in a chemical bath in an aqueous medium containing acid, alkaline or neutral products, these having disadvantages associated with the required subsequent treatment of the waste water after cleaning.

In this context, a second category of methods for the treatment or preparation of metal surfaces has emerged, these being referred to as "dry methods". One example in this category is cleaning surfaces by gaseous plasma under low pressure using an electric discharge. This method is at first sight very attractive, as it has the advantage of showing great respect for the environment. It unites two separate operations of the electric discharge, i.e. on the one hand, the intense ion bombardment induced under certain conditions by the ionized medium, i.e. a cleaning operation by atomization, and, on the other hand, the method makes use of the high reactivity of the excited atoms and molecules present in the plasma in order to form volatile compounds with the bodies to be eliminated present on the surface of the sheet metal, i.e. chemical action on bodies of an essentially organic nature. The gaseous atmosphere generally preferred for this method of pickling under electric discharge contains a high percentage of argon on account of its highly plasmagenic gas quality and on account of the high mass of its ions promoting the atomization of this gas. It is moreover enriched with oxygen or hydrogen in order to use part of the chemical action of the discharge by eliminating the organic bodies present on the surface of the sheet metal by the formation of light compounds of the $CO_x$ or $CH_y$ type.

The high potential of this process cannot hide its major disadvantages connected to the fact that it is carried out under low pressure, or even in vacuo. These pressure conditions are undeniably curbing its development as they are relatively incompatible with the treatment of large metal surfaces or with high production rates (as is the case with the industrial production of sheet metal).

The use of low pressures of this kind moreover represents considerable additional expenditure. In a more general context, in French Patent Application published under the No. 2 697 456, the Applicant proposed a process for the plasma fluxing of metal surfaces prior to soldering or tinning at atmospheric pressure, the plasma being created by means of a microwave source or a corona discharge transferred via ports arranged in a suitable manner in a dielectric layer situated above the component to be treated.

Although this application provides an advantageous solution to the problem of the fluxing of metal surfaces, the Applicant has demonstrated the fact that the proposed process could be improved, inter alia with respect to:

its yield (ratio between the power introduced in order to create the plasma and the density of the species produced actually interacting with the support to be treated) or the energy density obtained (in the case of corona discharge it only reaches a few W per dielectric unit area), which, if increased, could allow for shorter treatment times, but also as a result of limiting "geometric" factors: in the case of conventional corona discharge, the distance between the electrode and the sample is quite critical and must be kept very small, which can cause problems in the case of uneven substrates. In the case of microwave discharge, it gives rise to the formation of a plasmagenic spot of predetermined dimensions limited by the plasma source, moreover, a plasma such as the one created in this document by definition contains ionic species and electrons (and therefore electrically charged species) which can induce ion bombardment and thus atomization of the metal surface which can in some cases prove to be harmful (e.g. when the metal surface is covered in a coating it is desired not to alter).

In parallel to this, in French Patent Application published under the No. 2 692 730, the contents of which are incorporated hereby reference, the Applicant proposed a device for the production of excited or unstable gas molecules operating substantially at atmospheric pressure.

SUMMARY AND OBJECTS OF THE INVENTION

In this context, the aim of this invention is to propose an improved process for the dry treatment of metal surfaces, by which means it is possible:

to operate substantially at atmospheric pressure, to obtain high flexibility with respect to the distance between the object to be treated and the device used to carry out this treatment, to avoid contact between the components and electrically charged species, and to offer improved energy density allowing for an increased treatment rate.

To this end, the process for the dry treatment of surfaces of at least one metal surface portion according to the invention is characterized in that the metal surface portion is treated at a pressure close to atmospheric pressure by a gaseous treatment atmosphere comprising excited or unstable species and substantially devoid of electrically charged species.

BRIEF DESCRIPTION OF THE DRAWINGS

Other features and advantages of this invention will be clear from the following description of several embodiments given by way of non-limiting examples with reference to the accompanying drawings, in which.

DETAILED DESCRIPTION OF PREFERRED EMBODIMENTS

Figure 1:
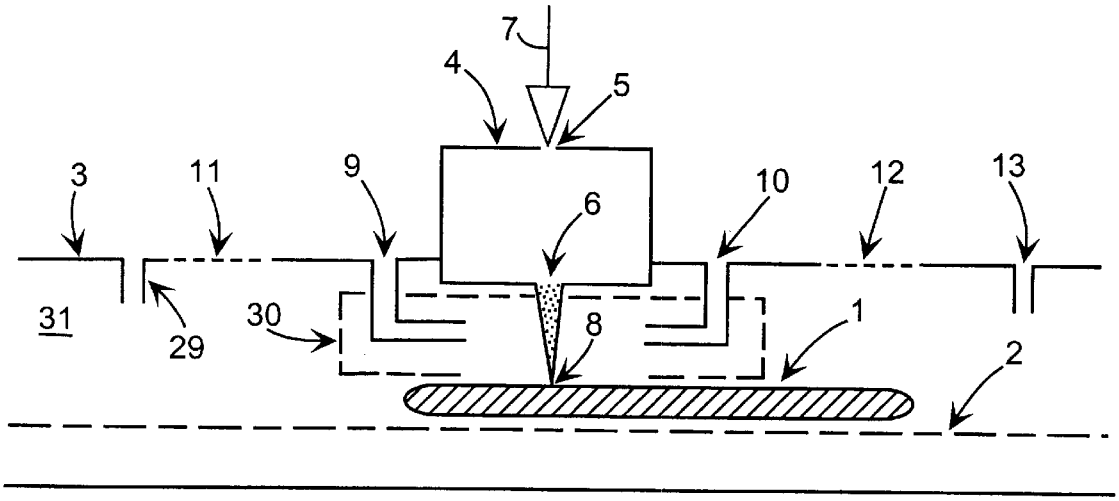
FIG. 1 is a diagrammatic view of an installation suitable for carrying out the process according to the invention.

The phrase "metal surface" as used according to the invention refers to any type of surface, which may be made, e.g. of steel, stainless steel, copper or aluminium, irrespective of the dimensions or thickness of the component including the metal surface portion or portions to be treated. Their final industrial application can be very varied, these metal surfaces being used, e.g. in the field of electric household appliances, motor vehicles, commercial gases or in the building or packaging industry.

The expression "surface treatment" as used according to the invention refers to any stage for the preparation, cleaning, activation or degreasing of the metal surface portion, wherein this stage can take place at very different parts of the production line for the products using metal surfaces of this kind (irrespective of whether they are flat, e.g. sheet metal, or hollow, e.g. bottles), and this stage can take place at the end of the production line (e.g. before sheet metal of this kind is coiled) or in the course of manufacture, prior to a subsequent process which may be, e.g. annealing, an operation such as the electroplating of zinc, aluminium, tin or alloys thereof, or the deposition of organic coatings, such as a varnish or a paint, or of inorganic coatings, such as nitride or films based on silicon.

The aim of the application of the surface treatment process according to the invention is therefore in particular to facilitate the application of the subsequent process, e.g. to facilitate the bonding of a coat of paint.

The surface treatment process according to the invention may therefore be applied alone or in addition to another surface preparation method carried out before or after the application of the process according to the invention.

The phrase "pressure close to atmospheric pressure" as used according to the invention refers to a pressure situated in the range [$0.1\times10^5$ Pa, $3\times10^5$ Pa].

The treatment atmosphere according to the invention differs from conventional plasma atmospheres in that it is substantially devoid of electrically charged species, i.e. ions and electrons.

The gaseous treatment atmosphere is obtained from a primary gaseous mixture and, if necessary, an adjacent gaseous mixture, the primary gaseous mixture being obtained at the gas outlet of at least one device for the production of excited or unstable gaseous species, in which an initial gaseous mixture comprising an inert gas and/or a reducing gas and/or an oxidizing gas has been converted, the adjacent mixture not having passed through the device.

The device according to the invention is formed by any apparatus for "exciting" an initial gaseous mixture in order to obtain at the gas outlet of the device another gaseous mixture including unstable or excited gaseous species, this latter gaseous mixture being substantially devoid of electrically charged species. Excitation of this kind may be obtained, e.g. by an electric discharge, e.g. of the corona discharge type.

This arrangement may be described as "post-discharge" as the primary component of the treatment atmosphere comprising excited or unstable gaseous species is obtained at the outlet of the device, thereby ensuring the substantial absence of any electrically charged species in this primary component. The adjacent component of the treatment atmosphere which has not passed through the device is devoid of these a fortiori.

This arrangement moreover allows for a distinct separation between the site at which the primary component of the atmosphere is generated and the site at which it is used, this offering a significant advantage from the point of view of contamination of the device (preventing the various emissions resulting from the surface treatment operation from contaminating the interior of the device, e.g. its electrodes). Finally, the component which is not treated within the device (e.g. within the discharge between the electrodes) benefits from improved flexibility from the "distance" point of view as described hereinabove.

The inert gas may consist, e.g. of nitrogen, argon, helium or a mixture of inert gases of this kind. The reducing gas may consist, e.g. of hydrogen, $CH_4$, natural gas, propane or ammonia or a mixture of reducing gases of this kind. The oxidizing gas for its part may consist, e.g. of oxygen or $CO_2$ or $N_2O$, $H_2O$ or a mixture of oxidizing gases of this kind. The list of gases in each category is of course only given by way of example and is in no way limiting.

As will be clear to the person skilled in the art, the initial gaseous mixture according to the invention is treated or converted in at least one device for the production of excited or unstable gaseous species so as to obtain at the gas outlet of the said device a gaseous mixture referred to as a primary gaseous mixture comprising excited or unstable gaseous species.

As will also be clear to the person skilled in the art, the component comprising the surface portion or portions to be treated may be brought into contact with the primary gaseous mixture obtained at the gas outlet of one single device for the production of excited or unstable gaseous species or of several devices arranged in parallel over the width of the component or successively with the primary gaseous mixtures obtained at the gas outlets of several devices for the production of excited or unstable gaseous species arranged in series.

The process according to the invention can be applied in accordance with the user's requirements both to the treatment of only one face of the component to be treated and to the case where the component is to be treated on both faces. In this latter case, the necessary devices are advantageously disposed opposite each face of the component.

According to the invention, the adjacent mixture may consist of any gas or gas mixture, e.g. an inert gas or a mixture of inert gases so that it is possible to maintain a protective atmosphere around the components if necessary, or a reducing gas or an oxidizing gas, or even a mixture of gases belonging to one of these three categories.

According to one of the features of the invention, the adjacent mixture contains silane $SiH_4$. A mixture of this kind containing silane is advantageously used on account of its reducing action with respect to certain metal oxides present on the surface of the component, but also, depending on the initial gaseous mixture used, as an oxygen "scavenger" or trapper, i.e. in its interaction with the residual oxygen from the atmosphere present above the component in order to minimise this residual oxygen level.

According to one of the embodiments of the invention, the metal surface portion to be treated is brought to a temperature of no more than 600° C., typically between ambient temperature and 600° C.

According to one of the embodiments of the invention, the component including the portion to be treated is brought opposite the gas outlet of the said device, if necessary opposite the gas outlets of several devices arranged in parallel over the width of the component and/or successively opposite the gas outlets of several devices arranged in series by a conveying system traversing an inner space delimited by a tunnel or a hood assembly sealed off from the surrounding atmosphere, the tunnel or assembly being connected in a sealed manner to the device or including the device.

The same remark made hereinabove also applies here with respect to treatment on both faces (here once again, the devices simply have to be used in the required number and arrangement opposite each face of the component).

Depending on the industry in question, the conveyor according to the invention may consist, e.g. of a belt or, in the case of sheet metal, of rollers.

According to one of the embodiments of the invention, the device in which the initial gaseous mixture is converted is the seat of an electric discharge created between a first electrode and a second electrode, a layer of a dielectric material being disposed on the surface of at least one of the electrodes opposite the other electrode, the initial gaseous mixture traversing the discharge transversely to the electrodes.

According to one of the features of the invention, the energy used in the device, corrected for the dielectric unit area, is therefore advantageously greater than 1 $W/cm^2$, preferably greater than 10 $W/cm^2$.

According to one of the embodiments of the invention, the treatment atmosphere encountered successively by the component to be treated along the conveyor is divided into zones as follows:

a) at least one of the devices for the production of excited or unstable gaseous species converts a different initial gaseous mixture from that converted by the device preceding it in the tunnel or assembly, and/or b)the adjacent gaseous mixture used at at least one of the devices for the production of excited or unstable gaseous species is different from that used at the device preceding it in the tunnel or assembly.

According to one of the embodiments of the invention, stages a) and b) hereinabove may relate to one single device.

It would therefore be possible, e.g. to use mixtures with reducing power increasing from one device to the next.

The invention also relates to an apparatus for the dry surface treatment of at least one metal surface portion, suitable in particular for carrying out the process according to the invention, comprising a tunnel or a hood assembly defining an inner space traversed by conveying means for the components including the surface portion or portions to be treated, sealed off with respect to the surrounding atmosphere, connected in a sealed manner to or including one or more devices for the production of excited or unstable gaseous species arranged in series and/or in parallel, comprising at least one tubular gas passage having an axis formed between an outer electrode and an inner electrode, at least one of the electrodes including a dielectric coating opposite the other electrode, the electrodes being connected to a high-voltage and high-frequency source, the outer electrode surrounding the dielectric and including an inlet for the gas referred to as the initial gas and an outlet for the gas referred to as the primary gas, this inlet and outlet being elongated, parallel to the axis and substantially diametrically opposite one another, the gas outlet opening into the interior of the tunnel or assembly, the tunnel or assembly being provided if necessary with at least one means for the injection of a gas referred to as the adjacent gas not having passed through the device or devices, the apparatus in addition comprising if necessary a means for heating the components to be treated.

This heating means may consist, e.g. of infrared lamps present in the tunnel or convection heating (warm walls in the tunnel) or the component may be placed on a heating substrate carrier.

FIG. 1 shows a component 1 including the metal surface portion or portions to be treated brought by a conveying means 2 opposite the gas outlet 6 of a device 4 for the production of excited or unstable gaseous species.

The conveying system 2 traverses an inner space 31 delimited by a tunnel 3 advantageously connected in a sealed manner to the device 4.

The primary gaseous mixture obtained at the outlet 6 of the device is indicated in diagrammatic form at 8. The primary gaseous mixture 8 is obtained from an initial gaseous mixture 7 entering the device at its gas inlet 5.

The embodiment illustrated in FIG. 1 also shows inlets for adjacent gaseous mixtures 9, 10. The gaseous atmosphere comprising the adjacent gaseous mixtures 9, 10 and the primary gaseous mixture 8 form the treatment atmosphere 30 according to the invention.

The embodiment illusrated in FIG. 1 shows additional devices for the production of excited or unstable gaseous species (not shown) at 11 and 12, arranged in series with the first device 4 and successively encountered by the component 1.

The installation can therefore be supplemented by other inlets for adjacent gas mixtures, such as those shown at 13 and 29.

The installation is moreover provided if necessary with a means for heating the component 1 (not shown in FIG. 1). This heating means may consist, e.g. of infrared lamps present in the tunnel or convection heating (warm walls in the tunnel) or the component may be placed on a heating substrate carrier.

Figure 2:
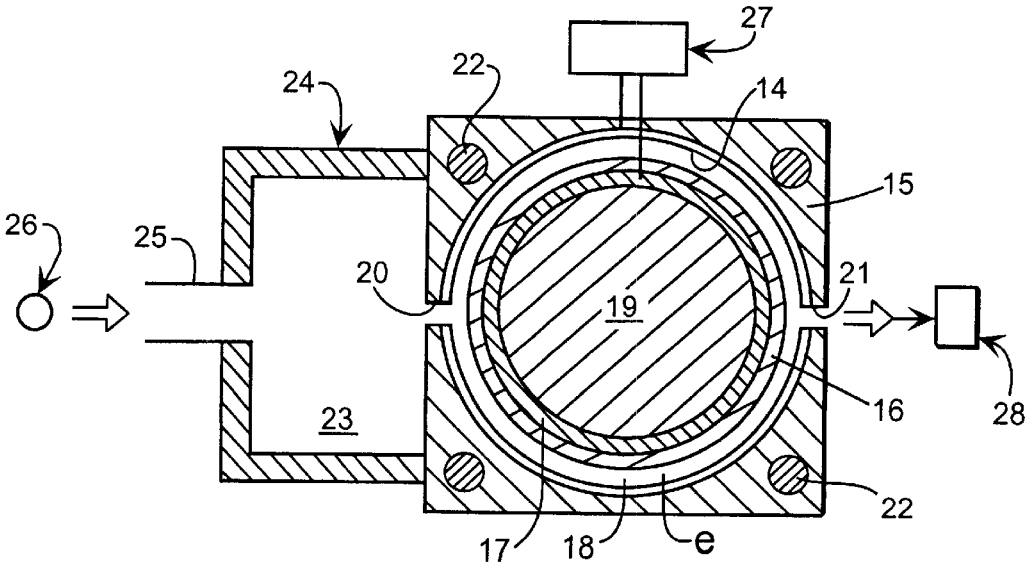
FIG. 2 is a diagrammatic section of an example of a device for the production of excited or unstable gaseous species suitable for carrying out the process according to the invention.

As shown in the embodiment of FIG. 2, the device for this embodiment is of cylindrical shape. It comprises a first tubular electrode 14 formed, e.g. by an inner face of a metal block 15 in which an assembly consisting of a tube 16 of dielectric material, e.g. ceramics, is concentrically disposed and on the inner face of which a second electrode 17, shown with exaggerated thickness in FIG. 2 for the sake of clarity, is deposited by electroplating.

The assembly consisting of the dielectric 16 and the second electrode 17 therefore defines together with the first electrode 14 a tubular gas passage 18 and, in the interior, an inner volume 19 in which a coolant is circulated, advantageously a Freon on account of its electronegative character, or exchanged water. The inner gas passage 18 has an axial extent of less than 1 m, typically less than 50 cm and its radial thickness is no more than 3 mm and is typically less than 2.5 mm.

The block 15 includes two diametrically opposing longitudinal slots 20 and 21 forming respectively the inlet for the initial gas to be excited in the passage 18 and the outlet for the flux of primary gas including excited or unstable gaseous species.

The slots 20 and 21 extend over the entire axial length of the cavity 18 and have a height which, in the embodiment shown, is no greater than the thickness e and is typically substantially identical to the latter. The body 15 advantageously includes on the periphery of the first electrode 14 a plurality of conduits 22 for the passage of a coolant, e.g. water. The gas inlet 20 communicates with a homogenizing chamber or plenum chamber 23 formed in a housing 24 coupled to the block 15 and including a tube 25 for conveying the initial gas at a pressure of between $0.1\times10^5$ Pa and $3\times10^5$ Pa, originating from an initial gas source 26. The electrodes 14 and 17 are connected to a high-voltage and high-frequency electric generator 27 operating at a frequency advantageously higher than 15 kHz and delivering a power, e.g. of approximately 10 kW. This power delivered by the generator may also advantageously be expressed by correcting it for the dielectric surface area (i.e. for the dielectric electrode unit area).

The gaseous flux containing the excited species available at the gas outlet 21 is sent to a user station 28, e.g. for the treatment of metal surfaces.

An installation such as the one described in association with FIG. 1 was used to put an embodiment of the invention into effect.

The installation comprised one single device for the production of excited or unstable gaseous species at 4, as described in association with FIG. 2. For this embodiment, cold-rolled low-carbon steel sheet metal having a thickness of 0.2 mm was treated. The samples treated were square (with dimensions of 10 cm).

The treatment atmosphere used included the addition of an adjacent mixture consisting of nitrogen and a primary gaseous mixture obtained from an initial mixture of nitrogen and hydrogen with 40% hydrogen.

The initial mixture was obtained with respective nitrogen and hydrogen throughputs of 10 $m^3$/h and 7 $m^3$/h. During treatment, the steel components were brought to a temperature of 150° C. by means of a heating substrate carrier. The pressure in the interior of the tunnel was maintained substantially at the level of atmospheric pressure. The energy density used per square cm of dielectric was 15 W/$cm^2$. The distance between the component and the gas outlet of the device was 10 mm.

Each steel component was treated as it passed by virtue of the conveying means 2 in 2 mn. The surface cleaning quality obtained in this manner was tested by the subsequent deposition of silica, its adherence to the steel components treated in this manner being assessed. The adherence of a deposition of 5000 Angstrom of silica to steel components of this kind was assessed by the method known as the "scotch" method, this being a standard test in the art.

The scotch test was applied in this case as follows:

the silica deposition was effected and engraved so as to create 100 squares over a surface area of 1 $cm^2$ of a steel sample (10 cm by 10 cm), each square having an approximate surface area of 1 $mm^2$. After deposition, an adhesive tape was stuck firmly over this $cm^2$ of the surface area of the sheet metal sample, then removed. The test therefore consisted in counting the squares removed from and fixed to the inner face of the tape. The results obtained after surface cleaning as described hereinbefore in this embodiment revealed a result of 100% of the silica squares remaining in place on each sheet metal component, corresponding to the removal of zero squares on the inner face of the tape. This result can be compared to the case where the metal component was not cleaned by the process according to the invention, but was simply degreased with the aid of a solvent, such as hexane. This resulted in 100% of the squares being removed from these untreated metal components, corresponding to zero squares of silica remaining in place on the metal component.

Although this invention has been described with reference to particular embodiments, it is not limited thereto, but, on the contrary, can be subject to any modifications and variations obvious to the person skilled in the art within the scope of the accompanying claims.

We claim:

1. Process for dry surface treatment of at least one metal surface portion of a component comprising treating the portion at a pressure in the range from $0.1\times10^5$ Pa to $3\times10^5$ Pa by a gaseous treatment atmosphere formed by passing an initial gaseous mixture comprising an inert gas, a reducing gas, an oxidizing gas, or mixtures thereof through at least one corona discharge device for producing excited or unstable gaseous species;

converting by corona discharge in the device said initial gaseous mixture into a primary gaseous mixture including excited or unstable species substantially devoid of electrically charged species;

directing said primary gaseous mixture from a gas outlet of the device to flow toward the metal surface portion; and directing a secondary gaseous mixture which is not passed through the device into the flow of the primary gaseous mixture to form said gaseous treatment atmosphere.

2. Process according to claim 1 wherein the secondary mixture includes silane $SiH_4$.

3. Process according to claim 1 further comprising bringing the component including the metal portion to be treated to a temperature of no more than 600° C.

4. Process according to claim 1 further comprising bringing the component including the metal portion to be treated into a position opposite the gas outlet of said device, or optionally, wherein said device comprises a plurality of devices, the process further comprising bringing the component including the metal portion to be treated into a position opposite respective gas outlets of the plurality of said devices arranged in parallel over a width of the component or bringing the component including the metal portion to be treated into a positions successively opposite respective gas outlets of the plurality of said devices arranged in series by a conveying system, comprising a conveyor, traversing an inner space delimited by a tunnel or a hood assembly sealed off from a surrounding atmosphere, said tunnel or assembly being connected in a sealed manner to said device or including said device, or combination thereof.

5. Process according to claim 1 wherein said device, in which said initial gaseous mixture is converted, is a seat of an electric discharge created between a first electrode and a second electrode, wherein a layer of a dielectric material is disposed on a surface of at least one of the first and second electrodes opposite the other of the first and second electrodes, said initial gaseous mixture traversing the discharge transversely to the first and second electrodes.

6. Process according to claim 1 wherein energy used in said device, corrected for a dielectric unit area, is greater than 1 W/$cm^2$.

7. Process according to claim 4 further comprising dividing the treatment atmospheres encountered successively by the component to be treated along the conveyor, into zones as follows: at least one of the plurality of said devices arranged in series for the production of excited or unstable gaseous species, converts a different initial gaseous mixture from that converted by the device adjacent thereto in said tunnel or assembly.

8. Process according to claim 4 further comprising dividing the treatment atmosphere encountered successively by the component to be treated along the conveyor into zones as follows:

(a) at least one of the plurality of said devices arranged in series converts a different initial gaseous mixture from that converted by the device adjacent thereto in said tunnel or assembly, or (b) said secondary gaseous mixture used for at least one of the plurality of said devices is different from that used for the device adjacent thereto in said tunnel or assembly, or (c) a combination of stages (a) and (b).

9. Process according to claim 8 wherein stages a) and b) take place at one single device.

10. Process for dry surface treatment of at least one metal surface portion of a component comprising treating the portion at a pressure in the range from $0.1\times10^5$ Pa to $3\times10^5$ Pa by a gaseous treatment atmosphere formed by passing an initial gaseous mixture comprising an inert gas a reducing gas, an oxidizing gas, or mixtures thereof through at least one energy using device for producing excited or unstable gaseous species;

converting in the device said initial gaseous mixture into a primary gaseous mixture including excited or unstable species substantially devoid of electrically charged species using an energy corrected for a dielectric unit area greater than 10 $W/cm^2$;

directing said primary gaseous mixture from a gas outlet of the device to flow toward the metal surface portion; and directing a secondary gaseous mixture which is not passed through the device into the flow of the primary gaseous mixture to form said gaseous treatment atmosphere.

11. Process for dry surface treatment of at least one metal surface portion of a component comprising the steps of:

passing an initial gaseous mixture comprising an inert gas, a reducing gas, an oxidizing gas, or mixtures thereof through at least one corona discharge device for producing excited or unstable gaseous species;

converting in the device by corona discharge said initial gaseous mixture to a primary gaseous mixture including exited or unstable species and substantially devoid of electrically charged species;

directing said primary gaseous mixture from a gas outlet of the device to flow toward the metal surface portion;

directing a secondary gaseous mixture which is not passed through the device into the flow of the primary gaseous mixture; and treating the metal surface portion of the component at a pressure in the range from $0.1\times10^5$ Pa to $3\times10^5$ Pa by a gaseous treatment atmosphere comprising said primary and secondary gaseous mixtures.

12. The process according to claim 11 wherein said primary gaseous mixture is obtained at a site separate from where it is used to treat said metal surface portion of the component being treated.

* * * * *